US011158262B2

(12) United States Patent
Gu et al.

(10) Patent No.: US 11,158,262 B2
(45) Date of Patent: Oct. 26, 2021

(54) DISPLAY DEVICE HAVING VARIABLE POWER SOURCES

(71) Applicant: SAMSUNG DISPLAY CO., LTD., Yongin-si (KR)

(72) Inventors: Bon Seog Gu, Suwon-si (KR); Hong Soo Kim, Hwaseong-si (KR); Woo Mi Bae, Daegu (KR); Ki Wan Ahn, Seoul (KR); Joo Sun Yoon, Seoul (KR); Chong Chul Chai, Seoul (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/445,755

(22) Filed: Jun. 19, 2019

(65) Prior Publication Data

US 2020/0066207 A1 Feb. 27, 2020

(30) Foreign Application Priority Data

Aug. 23, 2018 (KR) ..... 10-2018-0098489

(51) Int. Cl.
*G09G 3/3258* (2016.01)
*G09G 3/3266* (2016.01)
*G09G 3/3275* (2016.01)

(52) U.S. Cl.
CPC ..... *G09G 3/3258* (2013.01); *G09G 3/3266* (2013.01); *G09G 3/3275* (2013.01); (Continued)

(58) Field of Classification Search
CPC .. G09G 3/3258; G09G 3/3275; G09G 3/3266; G09G 2310/08; G09G 2330/021; G09G 2320/0626; G09G 2320/045; G09G 2310/0216; G09G 3/2011; G09G 2360/16; G09G 2320/043; G09G 2320/0223;
(Continued)

(56) References Cited

U.S. PATENT DOCUMENTS 8,964,450 B2 * 2/2015 Ishizu ..... G11C 11/412 365/149
10,004,124 B1 * 6/2018 Ko ..... H01L 27/3244
(Continued)

FOREIGN PATENT DOCUMENTS

KR 10-2018-0041793 A 4/2018
KR 10-2018-0043434 A 4/2018
KR 10-2018-0091984 A 8/2018

*Primary Examiner* — Chad M Dicke
(74) *Attorney, Agent, or Firm* — Kile Park Reed & Houtteman PLLC

(57) ABSTRACT

A display device includes a display panel including pixels; a panel driver to supply a scan signal and a data signal to the pixels; and a power supply to generate a first supply voltage and a second supply voltage, and to change the first supply voltage and/or the second supply voltage to provide it to the pixels. The pixels emit light in response to the scan signal based on the data signal during an emission period where a voltage difference between the first supply voltage and the second supply voltage is larger than a first reference voltage. A first voltage difference between the first supply voltage and the second supply voltage at a start of the emission period is larger than an average voltage difference between the first supply voltage and the second supply voltage throughout the emission period.

17 Claims, 9 Drawing Sheets

(52) U.S. Cl.
CPC . *G09G 2310/08* (2013.01); *G09G 2320/0626* (2013.01); *G09G 2330/021* (2013.01)

(58) Field of Classification Search
CPC ... G09G 2310/0286; G09G 2300/0819; G09G 2300/0847
See application file for complete search history.

(56) References Cited

U.S. PATENT DOCUMENTS 10,037,798 B2 * 7/2018 Onuki ..... G11C 11/565
10,140,905 B2 * 11/2018 Choi ..... G09G 3/3688
10,319,305 B2 * 6/2019 Kishi ..... G09G 3/20
10,325,548 B2 * 6/2019 Kwon ..... G09G 3/2092
10,388,220 B2 * 8/2019 Chung ..... H01L 51/5296
10,540,927 B2 * 1/2020 Park ..... H01L 51/5203
10,622,436 B2 * 4/2020 Park ..... H01L 27/3265
2005/0200618 A1 * 9/2005 Kim ..... G09G 3/3233 345/204
2008/0170014 A1 * 7/2008 Jung ..... G09G 3/3233 345/82
2009/0091264 A1 * 4/2009 Chiou ..... G09G 3/3233 315/169.1
2009/0309863 A1 * 12/2009 Seto ..... G09G 3/3233 345/212
2010/0123693 A1 * 5/2010 Utsunomiya ..... G09G 3/3696 345/205
2011/0285688 A1 * 11/2011 Miyake ..... G09G 3/3614 345/211
2011/0292008 A1 * 12/2011 Iwabuchi ..... G09G 3/3291 345/204
2012/0098826 A1 * 4/2012 Lee ..... G09G 3/003 345/419
2012/0293481 A1 * 11/2012 Chaji ..... G06F 3/038 345/212
2014/0340379 A1 * 11/2014 Kim ..... G09G 3/3225 345/212
2016/0078814 A1 * 3/2016 Ryu ..... G09G 3/003 345/690
2016/0203759 A1 * 7/2016 Han ..... G09G 3/3233 345/212
2016/0226651 A1 * 8/2016 Kim ..... H04L 25/026
2017/0186372 A1 * 6/2017 Yanase ..... G09G 3/3233
2018/0226028 A1 * 8/2018 Park ..... G09G 3/3258
2019/0035336 A1 * 1/2019 Park ..... G09G 3/3225
2019/0311682 A1 * 10/2019 Pyo ..... G09G 3/3258
2020/0066207 A1 * 2/2020 Gu ..... G09G 3/3275
2020/0090572 A1 * 3/2020 Wu ..... G09G 3/20

* cited by examiner

DISPLAY DEVICE HAVING VARIABLE POWER SOURCES

CROSS-REFERENCE TO RELATED APPLICATION

Korean Patent Application No. 10-2018-0098489, filed on Aug. 23, 2018, in the Korean Intellectual Property Office, and entitled: "Display Device," is incorporated by reference herein in its entirety.

BACKGROUND

1. Field

The present disclosure relates to a display device.

2. Description of the Related Art

Display devices become more and more important as multimedia technology evolves. Among variety of types of display devices currently used an organic light-emitting display device includes a plurality of pixels each including an organic light-emitting element which is a self-luminous element. Each of the pixels includes a plurality of transistors and a storage capacitor for driving the organic light-emitting element.

SUMMARY

An embodiment of a display device includes a display panel having pixels; a panel driver to supply a scan signal and a data signal to the pixels; and a power supply to generate a first supply voltage and a second supply voltage and to change the first supply voltage and/or the second supply voltage to provide it to the pixels. The pixels emit light in response to the scan signal based on the data signal during an emission period where a voltage difference between the first supply voltage and the second supply voltage is larger than a first reference voltage. A first voltage difference between the first supply voltage and the second supply voltage at a start of the emission period is larger than an average voltage difference between the first supply voltage and the second supply voltage throughout the emission period.

An embodiment of a display device includes a display panel including pixels; a panel driver to supply a scan signal and a data signal to the pixels; a timing controller to receive image data comprising a gray value associated with each of the pixels and to generate a control signal based on the image data; and a power supply to generate a first supply voltage and a second supply voltage to provide them to the pixels and to change the first supply voltage and/or the second supply voltage based on the control signal. The pixels emit light in response to the scan signal based on the data signal during an emission period where a voltage difference between the first supply voltage and the second supply voltage is larger than a first reference voltage. During the emission period, the voltage difference between the first supply voltage and the second supply voltage varies according to the average gray level of the image data.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
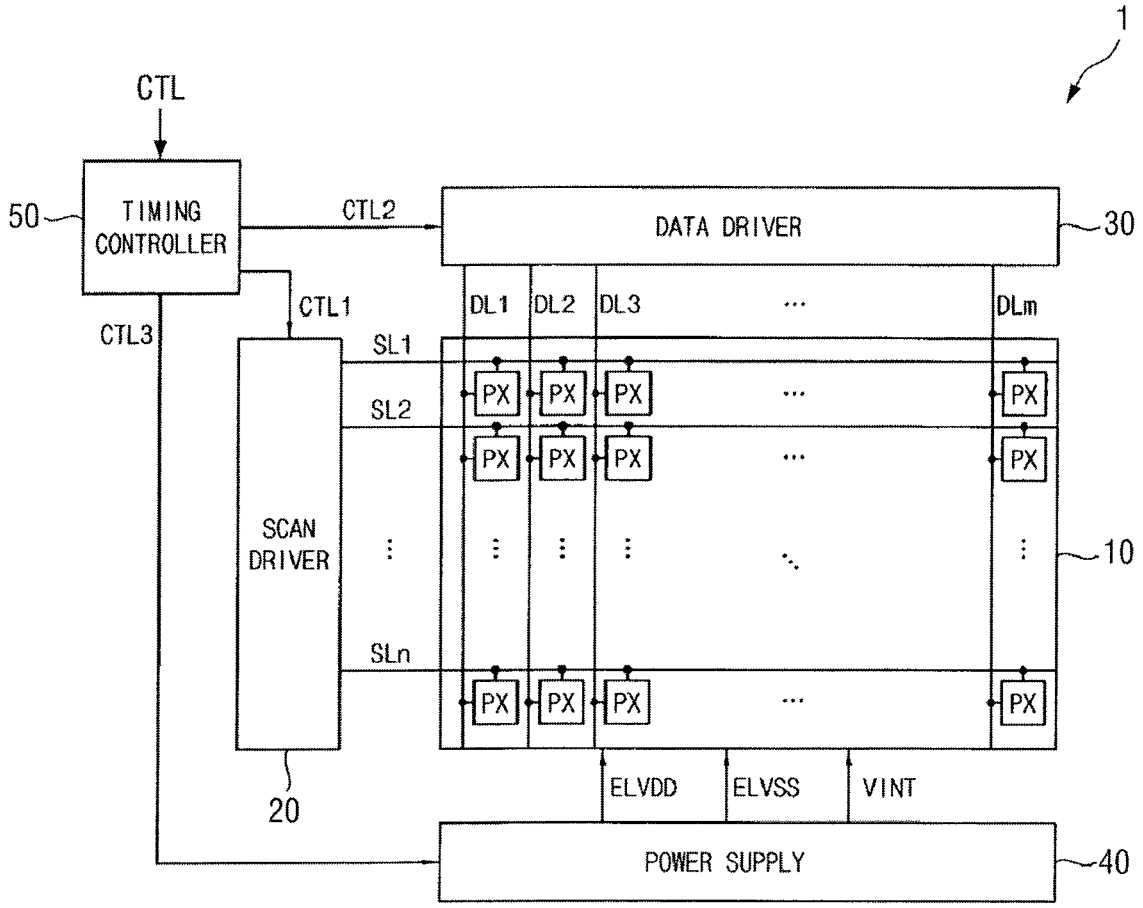
FIG. 1 illustrates a block diagram of a display device according to an exemplary embodiment of the present disclosure.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the disclosure.

Hereinafter, exemplary embodiments of the present disclosure will be described in detail with reference to the accompanying drawings. Hereinafter, an organic light emitting display device will be described as an example of a display device.

FIG. 1 is a block diagram of a display device according to an exemplary embodiment of the present disclosure. Referring to FIG. 1, a display device 1 may include a display panel 10 and a panel driver unit.

The display panel 10 may include first to $n^{th}$ scan lines SL1 to SLn, first to $m^{th}$ data lines DL1 to DLm, and pixels PX, where n and m are positive integers. A pixel PX (or a pixel circuit) may be a minimum unit that emits light in the display panel 10. The pixels PX may be at the intersections of the first to the $n^{th}$ scan lines SL1 to SLn and the first to the $m^{th}$ data lines DL1 to DLm, respectively. In the display panel 10, the pixels may be arranged in n-by-m matrix. The pixels may emit light simultaneously in response to a supply voltage that fluctuates (or changes) within one frame period. The structure and driving of the pixels PX will be described later.

The panel driver unit may include a scan driver 20, a data driver 30, a power supply 40, and a timing controller 50.

The scan driver 20 may generate a scan signal based on a first control signal CNT1 and may provide the scan signal to the first to the $n^{th}$ scan lines SL1 to SLn. For example, the scan driver 20 may sequentially supply the scan signal to the first to the $n^{th}$ scan lines SL1 to SLn.

The data driver 30 may convert image data in the form of digital signal into an analog data signal in response to a second control signal CNT2 and may supply the data signal to the first to $m^{th}$ data lines DL1 to DLm.

The pixel PX may receive a data signal (i.e., through the first to the $m^{th}$ data lines DL1 to DLm) in response to a scan signal (i.e., a scan signal transmitted through the first to the $n^{th}$ scan lines SL1 to SLn) and may emit light with a luminance corresponding to the data signal.

The power supply 40 may generate supply voltages having voltage levels that fluctuate (or vary) within one frame period in response to a third control signal CNT3. For example, the power supply 40 may generate a first supply voltage ELVDD and a second supply voltage ELVSS. Further, the power supply 40 may generate an initializing voltage VINT.

For example, the power supply 40 may include a DC-DC converter that generates output voltages having various voltage levels from an input voltage (e.g., battery voltage), and switches that select the output voltages as a first supply voltage ELVDD, a second supply voltage ELVSS, and an initializing voltage VINT based on a third control signal CNT3 to set the voltage levels for the first supply voltage ELVDD, the second supply voltage ELVSS and the initializing voltage VINT, respectively.

The timing controller 50 may generate image data suitable for the display panel 10 based on the input image data to provide the image data to the data driver 30, and may control the scan driver 20, the data driver 30 and the power supply 40. For example, the timing controller 50 may receive a control signal CNT from an external circuit, e.g., a system board. The timing controller 50 may generate the first to third control signals CTL1 to CTL3 to control the scan driver 20, the data driver 30, and the power supply 40, respectively. The first control signal CTL1 may include a scan start signal, a scan clock signal, etc. The second control signal CTL2 may include a horizontal start signal, a load signal, image data, etc. The third control signal CTL3 may include a switch control signal, etc.

The display device 1 may be a head mounted display (HMD). In this case, the display device 1 may be mounted on the user's head and may enlarge the image (i.e., the image output from the display panel) using the lens to provide the image directly in front of the user's eyes. When the display device 1 is driven in the sequential emission manner, image lag, color blur, etc., may be perceived by viewers. For this reason, the pixel PX has a relatively simple structure, and the display device 1 is driven in the simultaneous emission manner, so that a relatively high display quality can be achieved.

Figure 2:
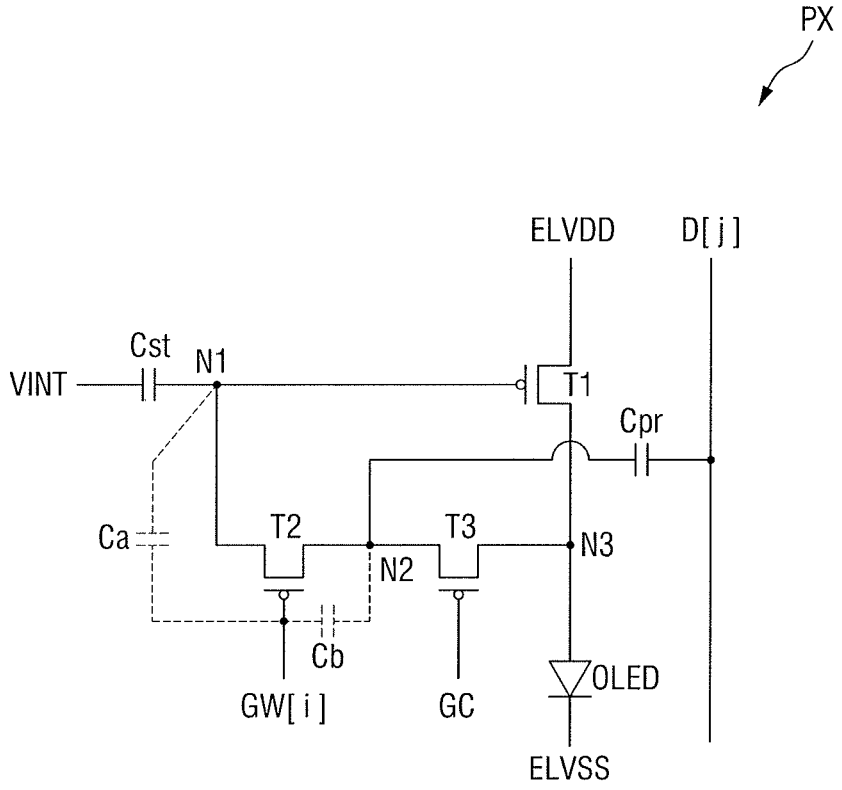
FIG. 2 illustrates a circuit diagram of a pixel included in the display device of FIG. 1.

FIG. 2 is a circuit diagram of a pixel included in the display device of FIG. 1. Referring to FIG. 2, a pixel PX may include a light-emitting element OLED, a first switching element T1, a second switching element T2, a third switching element T3, a first capacitor Cst, and a second capacitor Cpr. The pixel PX may be located in the $i^{th}$ pixel row and the $j^{th}$ pixel column.

Each of the first switching element T1, the second switching element T2, and the third switching device T3 may be a thin-film transistor. For example, each of the first switching element T1, the second switching element T2, and the third switching element T3 may be a PMOS transistor. For another example, each of the first switching element T1, the second switching element T2, and the third switching element T3 may be an NMOS transistor. Alternatively, some of the first switching element T1, the second switching element T2, and the third segment element T3 may be NMOS transistors and others may be PMOS transistors. In the following description, each of the first switching element T1, the second switching element T2, and the third switching element T3 is a PMOS transistor for convenience of illustration.

The first switching element T1 may include a first electrode connected to a driving voltage line to which the first supply voltage ELVDD is applied (or at which the first supply voltage ELVDD is received), a second electrode connected to a third node N3 (or an anode electrode of the light-emitting element OLED to be described later), and a gate electrode connected to the first node N1. One of the first electrode and the second electrode may be a source electrode, and the other may be a drain electrode. The first switching element T1 may transmit the driving current from the first supply voltage ELVDD to the third node N3 based on the voltage at the first node N1. For example, the first switching element T1 may be a driving transistor.

The second switching element T2 may include a first electrode (or a third electrode) connected to the first node N1, a second electrode (or a fourth electrode) connected to the second node N2, and a gate electrode electrically connected to the $i^{th}$ scan line (e.g., the selected one of the first to $n^{th}$ scan lines SL1 to SLn shown in FIG. 1) to receive a scan signal GW[i]. The second switching element T2 may electrically connect the first node N1 with the second node N2 in response to the scan signal GW[i]. For example, the second switching element T2 may transmit a second node voltage at the second node N2 (e.g., a data signal D[j] to be described later) to the first node N1 or may transmit a third node voltage at the third node (e.g., an initializing voltage VINT) to the second node N2 in response to the scan signal GW[i].

The third switching element T3 may include a first electrode (or a fifth electrode) connected to the second node N2, a second electrode (or a sixth electrode) connected to the third node N3, and a gate electrode electrically connected to a control signal line to receive a common control signal GC. The third switching element T3 may be electrically connected to the second node N2 and the third node N3 in response to the common control signal GC. For example, the third switching element T3 may transmit the second node voltage at the second node N2 (e.g., the initialing voltage VINT transmitted from the first node N1) to the third node N3 in response to the common control signal GC.

The first capacitor Cst may be electrically connected between an initializing power line (e.g., a line where the initializing voltage VINT is applied and transferred) and the first node N1. The first capacitor Cst may include a first capacitor electrode connected to the initializing power line and a second capacitor electrode connected to the first node N1. For example, the first capacitor Cst may be a holding or storage capacitor.

The second capacitor Cpr may be electrically connected between a data line (e.g., one selected from the first to $m^{th}$ data lines DL1 to DLm shown in FIG. 1, via which the data signal D[j] is transmitted) and the third node N3. For example, the second capacitor Cpr may include a first capacitor electrode for receiving the data signal D[j] from the data line and a second capacitor electrode electrically connected to the third node N3. The second capacitor Cpr may be a luminance compensating capacitor. The capacitance of the second capacitor Cpr may be larger than the capacitance of the first capacitor Cst.

The second capacitor Cpr may compensate for a reduction in the luminance of the light-emitting element. The luminance compensation performance of the second capacitor Cpr may be degraded by a first parasitic capacitor Ca, such that the display quality may deteriorate. By forming a second parasitic capacitor Cb, having a capacitance equal to or greater than the first parasitic capacitor Ca, the deterioration of the display quality may be reduced or prevented. In addition, when a scan signal supplied to the scan line is changed from the on-level to the off-level, even if a kickback voltage is generated at the first node N1, the voltage at the first node N1 may be held above the voltage at the second node N2. As a result, a cross-talk defect may be reduced or prevented.

The light-emitting element OLED may be electrically connected between the third node N3 and the second supply voltage line (i.e., the power line to which the second supply voltage ELVSS is applied). The light-emitting element OLED may emit light with a luminance in proportional to the driving current flowing through the first switching element T1. The light-emitting element OLED may include a first element electrode (e.g., an anode electrode) electrically connected to the third node N3, and a second element electrode (e.g., a cathode electrode) electrically connected to the second supply voltage line to which the second supply voltage ELVSS is applied.

As described above with reference to FIG. 2, in the pixel PX, the third switching element T3 may be between the second (fourth) electrode of the second switching element T2 (or the second node N2) and the first element electrode (or the third node N3) of the organic light-emitting element OLED, so that the second node N2 may be electrically disconnected or separated from the third node N3 by the third switching element T3. By doing so, even if a leakage current flows from the first supply voltage line receiving the first supply voltage ELVDD to the third node N3 through the first switching element T1 while the data signal D[j] is written to the gate electrode of the first switching element T1 (i.e., the first node N1), the data signal D[j] written to the gate electrode of the first switching element T1 may not be affected. As a result, the display quality of the pixel PX can be improved.

In addition, since the second capacitor Cpr is between the data line receiving the data signal D[j] and the third node N3, a reduction in the luminance of the light-emitting element due to the first parasitic capacitor Ca between the first node N1 or the first switching element T1 connected to the first node N1 and other elements may be compensated. As a result, the display quality can be further improved.

Figure 3:
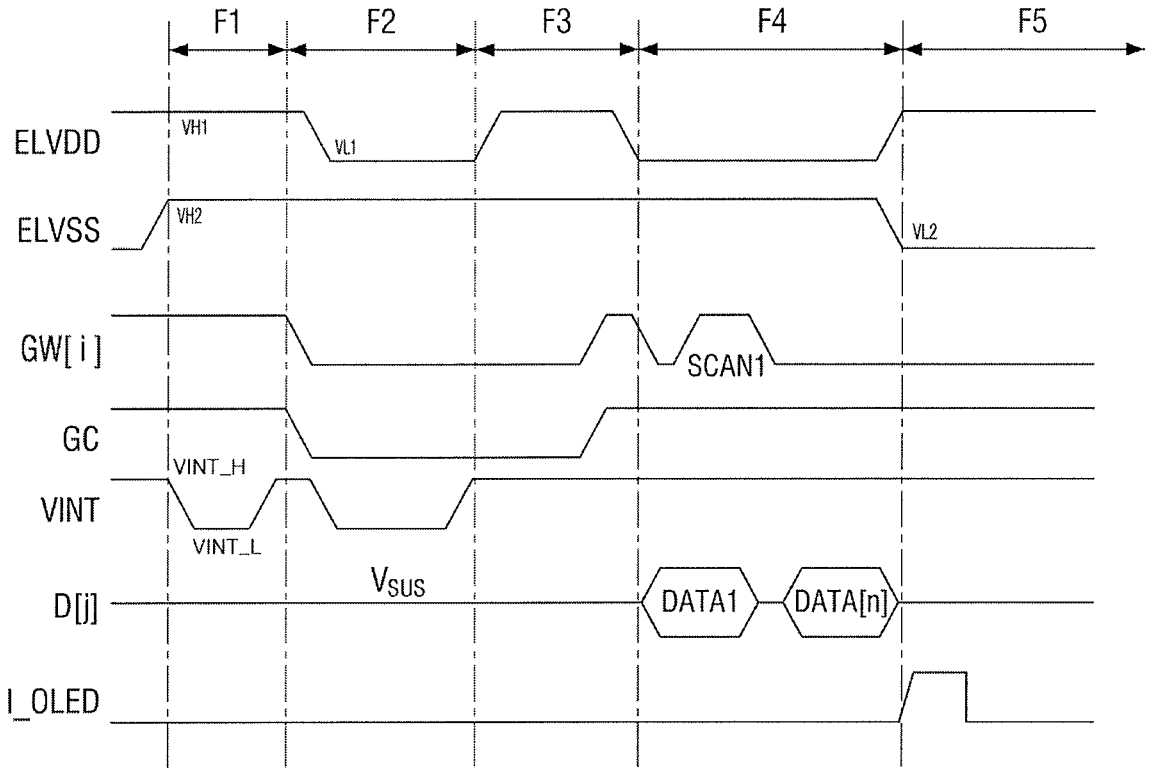
FIG. 3 illustrates a diagram showing the waveforms of the signals measured in the pixel of FIG. 2.

FIG. 3 is a diagram showing the waveforms of the signals measured in the pixel of FIG. 2. Referring to FIGS. 1 to 3, a single frame (or a period of time in which a single frame image is displayed) may include non-emission periods F1 to F4 in which the pixel PX does not emit light, and an emission period F5 in which the pixel PX emits light (or emits light simultaneously).

The non-emission periods may sequentially include a first initialization period F1 in which the voltage of the first element electrode of the light-emitting element OLED is initialized, a second initialization period F2 in which the gate electrode of the first switching element T1 is initialized, a threshold voltage compensation period F3 in which the gate electrode and the second electrode of the switching element T1 are electrically connected, and a data write period F4 in which the data signal D[j] is written in the pixel PX.

The first supply voltage ELVDD may have a first low voltage level VL1 or a first high voltage level VH1. The second supply voltage ELVSS may have a second low voltage level VL2 or a second high voltage level VH2. The initializing voltage VINT may have a first initializing voltage level VINT_L or a second initializing voltage level VINT_H.

A reference or sustain voltage Vsus may be applied to the data line other than during the data write period F4. During the data write period F4, a data signal D[j] representing a grayscale to be displayed may be provided to the data line.

The same common control signal GC may be provided to all the pixels included in the display panel 10.

In the first initialization period F1, the first supply voltage ELVDD may have the first high voltage level VH1 and the second supply voltage ELVSS may have the second high voltage level VH2. The second high voltage level VH2 may be equal to or greater than the first high voltage level VHL For example, the first high voltage level VH1 may be 6.2 V and the second high voltage level VH2 may be 6.5 V. In this example, since the first supply voltage ELVDD is equal to or less than the second supply voltage ELVSS (or a voltage difference between the first supply voltage ELVDD and the second supply voltage ELVSS is less than the threshold voltage of the first switching element T1), no driving current may flow in the light-emitting element OLED.

The scan signal GW[i] may have an "off" voltage level (a turn-"off" voltage level, a turn-off voltage, or a logic high level), and the common control signal GC may have an "off"

voltage level. Accordingly, each of the second switching element T2 and the third switching element T3 may be turned off or may remain turned off.

The initializing voltage VINT may have a first initializing voltage level VINT_L. In particular, at a start of the first initialization period F1, the initializing voltage VINT may transition from the second initializing voltage level VINT_H to the first initializing voltage level VINT_L and, at an end of the first initialization period F1, may transition back to the second initializing voltage level VINT_H. Thus, in the first initialization period F1, a bias voltage for the operation of the pixel PX may be applied.

In the second initialization period F2, the scan signal GW[i] and the common control signal GC may have an "on" voltage level (a turn-"on" voltage level, a turn-on voltage, a logic low level). The scan signal GW[i] and the common control signal GC may transition from the turn-off voltage to the turn-"on" voltage level at the start of the second initialization period F2. Accordingly, the second switching element T2 and the third switching element T3 may be turned on, and the gate electrode of the first switching element T1 and the second electrode of the switching element T1 may be connected to each other by the second switching element T2 and the third switching element T3.

Then, the first supply voltage ELVDD may transition from the first high voltage level VH1 to the first low voltage level VL1 and may remain at the first low voltage level VL1 during the second initialization period F2. The first low voltage level VL1 may have a voltage level lower than the voltage level of the first high voltage level VH1, e.g., may have a smaller magnitude or absolute value than the voltage level of the first high voltage level VH1. For example, the first low voltage level VL1 may be approximately −2.2 V. The second supply voltage ELVDD may have the second high voltage level VH2.

The initializing voltage VINT transitions to the first initializing voltage VINT_H at the end of the first initialization period F1 and, then, transitions back to the second initializing voltage VINT_L towards an end the second initialization period F2. The initializing voltage VINT may transition to the second initializing voltage VINT_L after the first supply voltage ELVDD transitions to the first low voltage level VL1. The initializing voltage VINT may transition back to the first initializing voltage VINT_H before the end of the second initialization period F2.

The voltage at the first node N1 and the voltage at the third node N3 equals the sum of the first low voltage level VL1 and the threshold voltage Vth of the first switching element T1 (i.e., VL1+Vth) due to the connection state between the first node N1 and the second node N3, and the first supply voltage ELVDD and the initializing voltage VINT. That is to say, the voltage at the first gate electrode of the first switching element T1 and the voltage at the first element electrode of the light-emitting element OLED is initialized.

At the start of the threshold voltage compensation period F3, the initializing voltage VINT may have the first initializing voltage level VINT_H and the first supply voltage ELVDD may transition to the first high voltage level VH1. The scan signal GW[i] and the common control signal GC may have the "on" voltage level. Accordingly, the voltage equal to the threshold voltage Vth of the first switching element T1 may be stored in the first capacitor Cst. Towards the end of the threshold voltage compensation period F3, the first supply voltage ELVDD may transition to the first low voltage level VL1 and the initializing voltage VINT may be maintained at the first initializing voltage level VINT_H. The scan signal GW[i] and the common control signal GC may transition to the "off" voltage level, with the scan signal GW[i] beginning to transition back to the "on" voltage level at the end of the threshold voltage compensation period F3.

At the start of the data write period F4, the first supply voltage ELVDD may have the first low voltage level VL1, the second supply voltage ELVSS may have the second high voltage level VH2, and the common control signal GC may have the "off" voltage level. As the common control signal GC has the "off" voltage level, the third switching element T3 may remain turned off, such that the second node N2 may be electrically disconnected from the third node N3.

The scan signal GW[i] may have the "off" voltage level and may have the "on" voltage level at a specific times. The data signal D[j] may have the first to $n^{th}$ data voltages DATA1 to DATA[n]. When the scan signal GW[i] has the "on" voltage level, the second switching element T2 is turned on and the data voltage (e.g., one of the first to the $n^{th}$ data voltages DATA1 to DATA [n]) may be transmitted or applied to the first node N1. Only the data signal D[j] in the form of an impulse can be transmitted to the first node N1 due to the second capacitor Cpr. The data signal D[j] transmitted to the first node N1 may be stored in the first capacitor Cst.

At the start of the data write period F4 (i.e., the first time before the scan signal GW[i] at the "on" voltage level is applied to the second switching element T2), the amount of the electric charges stored in the first capacitor Cst, the second capacitor Cpr, and a parasitic capacitor Coled of the light-emitting element OLED (i.e., the diode capacitor) can be calculated according to Equations 1 to 3 below:

$$Qst1=(VL1+Vth-VINT_H)\times Cst \quad \text{[Equation 1]}$$

$$Qpr1=(VL1+Vth-Vsus)\times Cpr \quad \text{[Equation 2]}$$

$$Qoled1=(VL1+Vth-VH2)\times Coled \quad \text{[Equation 3]}$$

where the Qst1, Qpr1, and Qoled1 represent an amount of charge stored in the first capacitor Cst, the second capacitor Cpr, and the parasitic capacitor Coled, respectively, at the first time. In addition, VL1 denotes the voltage level of the first supply voltage ELVDD, Vth denotes the threshold voltage of the first switching element T1, VINT_H denotes the voltage level of the initializing voltage VINT, Vsus denotes the reference voltage, VH2 denotes the voltage level of the second supply voltage, and Cst, Cpr and Coled denote the capacitances of the first capacitor Cst, the second capacitor Cpr, and the parasitic capacitor Coled, respectively.

In addition, at the second time of the data write period F4 immediately after the scan signal GW[i] having the "on" voltage level is applied to the pixel PX, an amount of charge stored in the first capacitor Cst, the second capacitor Cpr, and the parasitic capacitor Coled included in the pixel PX can be calculated according to Equations 4 to 6 below:

$$Qst2=(Vgate-VINT_H)\times Cst \quad \text{[Equation 4]}$$

$$Qpr2=(Vgate-DATA[i])\times Cpr \quad \text{[Equation 5]}$$

$$Qoled2=(Vgate-VH2)\times Coled \quad \text{[Equation 6]}$$

where the Qst2, Qpr,2 and Qoled2 represent the amounts of electric charges stored in the first capacitor Cst, the second capacitor Cpr and the parasitic capacitor Coled, respectively, at the second time. In addition, Vgate denotes the voltage at the gate electrode of the first switching element T1, VINT_H denotes the voltage level of the initializing voltage VINT, DATA[i] denotes the voltage of the data signal D[j], VH2 denotes the voltage level of the second supply voltage ELVSS, and Cst, Cpr, and Coled denote the capacitances of the first capacitor Cst, the second capacitor Cpr, and the parasitic capacitor Coled, respectively.

Since there is no current path in the first switching element T1 included in the pixel PX between the first and second times, the total amount of charges stored at the first and second times may be the same (i.e., Qst1+Qpr1+Qoled1=Qst2+Qpr2+Qoled2). The voltage at the gate electrode of the first switching element included in the pixel PX during the data write period F4 may be calculated according to the Equation 7 based on Equations 1 to 6 below:

$$Vgate = VL1 + Vth + \frac{(\mathrm{DATA}[i] - Vsus) \times Cpr}{(Cst + Cpr + Coled)} \quad \text{[Equation 7]}$$

Therefore, the voltage at the gate electrode of the first switching element T1 may be set independently of the voltage of the data signal at the different timings.

Towards the end of the data write period F4, the first supply voltage ELVDD may transition to the first high voltage level VH1, and the second supply voltage ELVSS may transition to the second low voltage level VL2. For example, the first supply voltage ELVDD may be approximately +6.2 V, and the second supply voltage ELVSS may be approximately −2.2 V. That is to say, the voltage difference between the first supply voltage ELVDD and the second supply voltage ELVSS may be larger than the first reference voltage for turning on the first switching element T1 (or a predetermined voltage difference between the first and second electrodes, e.g., approximately +8.4 V).

During the emission period F5, the scan signal GW[i] may have the "on" voltage level, the common control signal GC may have the "off" voltage level, and the initializing voltage VINT may remain at the first initializing voltage level VINT_H. During the emission period F5, the driving current I_OLED is generated in the first switching element T1 according to the change of the first supply voltage ELVDD and the second supply voltage ELVSS, and the driving current I_OLED may flow to the light-emitting element OLED through the first switching element T1. As a result, the pixel PX can emit light.

As described above with reference to FIG. 3, as the second node N2 is disconnected from the third node N3 by the third switching element T3 during the data write period F4 and the emission period F5, leaking of the driving current may be reduced or prevented. Therefore, a change in the data signal written to the pixel PX by the leakage current and the display quality deterioration due to the luminance deviation of the pixel PX, i.e., a mura, may be prevented.

In some exemplary embodiments, the first supply voltage ELVDD and/or the second supply voltage ELVSS may be overdriven during the emission period F5. That is to say, the voltage difference between the first supply voltage ELVDD and the second supply voltage ELVSS may be larger than a second reference voltage (e.g., approximately +9.4 V to +13.2 V) that is larger than the first reference voltage for turning on the first switching element T1 (or a predetermined voltage difference between the first and second electrodes). In this manner, emission delay of the pixel PX may be reduced and deterioration of the display quality due to the emission delay (e.g., occurrence of mura) may be prevented.

Figure 4:
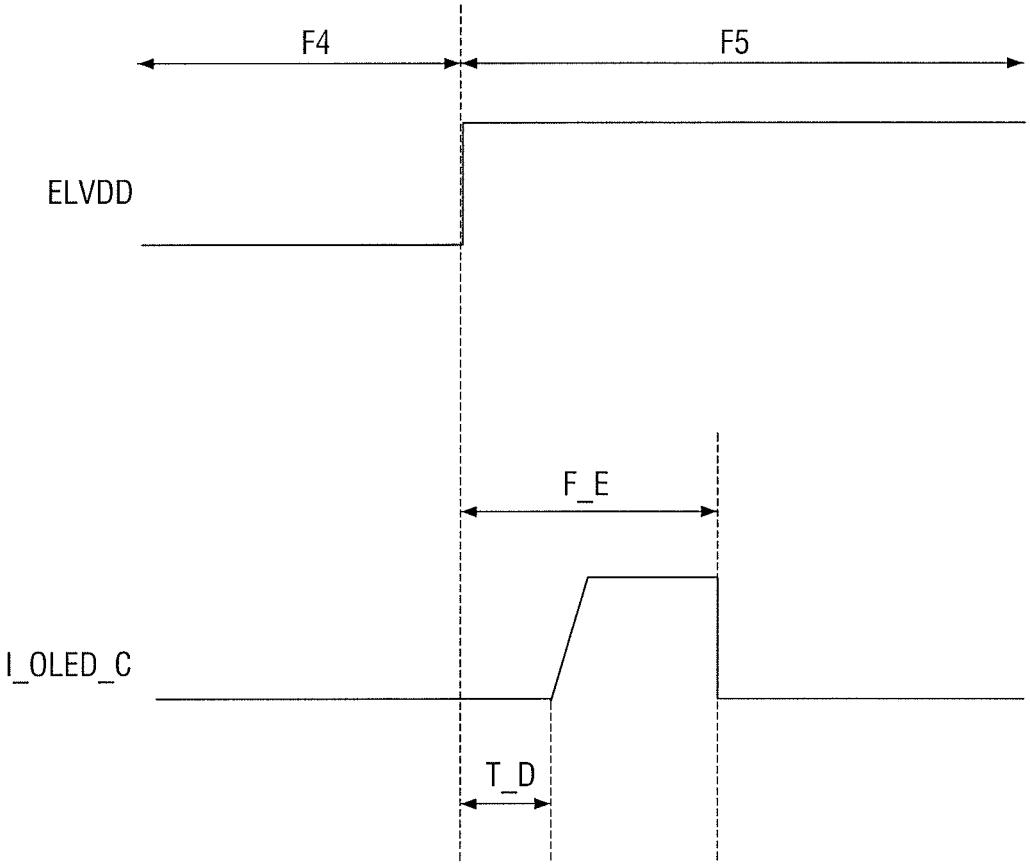
FIG. 4 illustrates a waveform diagram for the operation of the pixel according a normal mode as the first supply voltage applied to the pixel of FIG. 2 changes.
Figure 5:
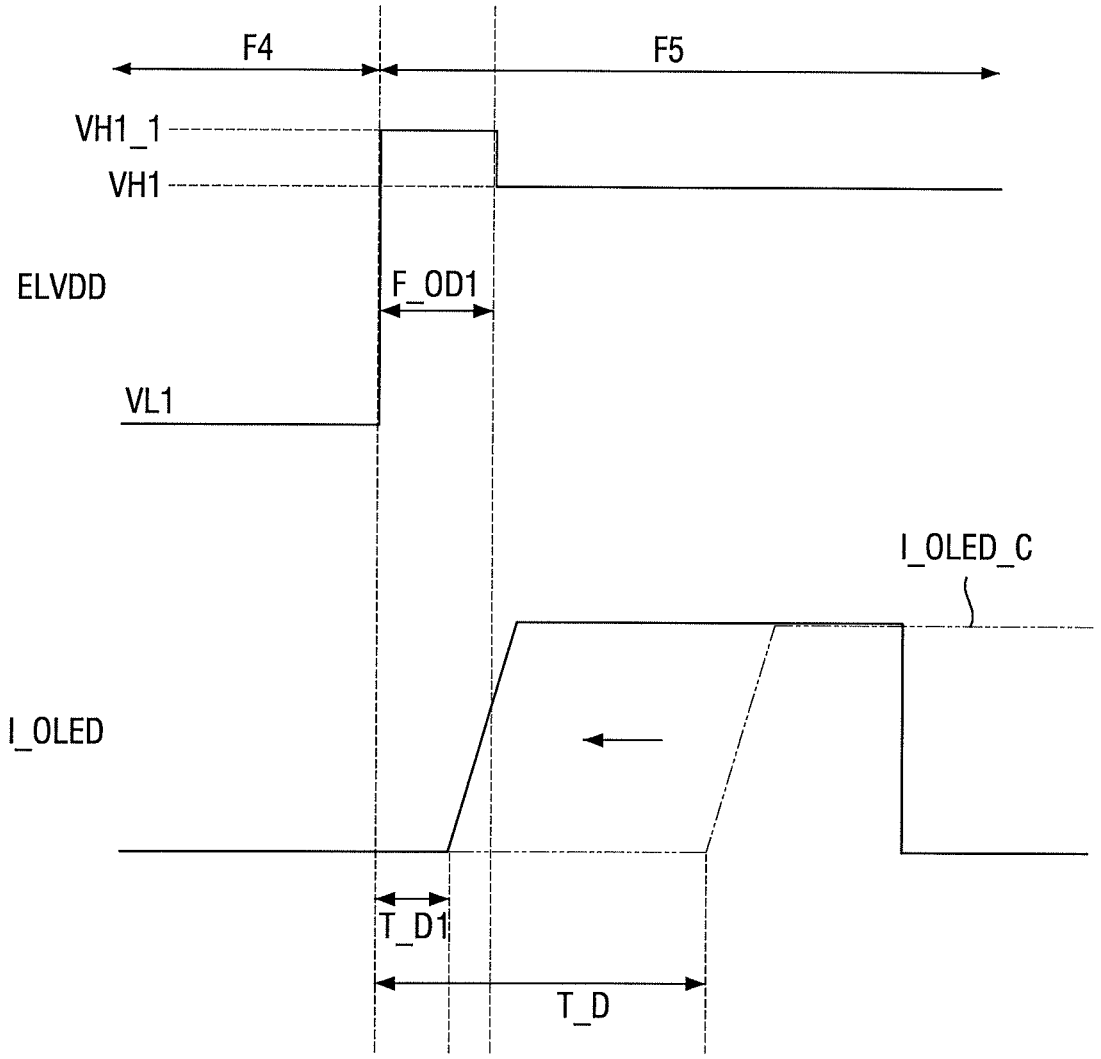
FIG. 5 illustrates a waveform diagram for an example of the operation of the pixel as the first supply voltage applied to the pixel of FIG. 2 changes.
Figure 6:
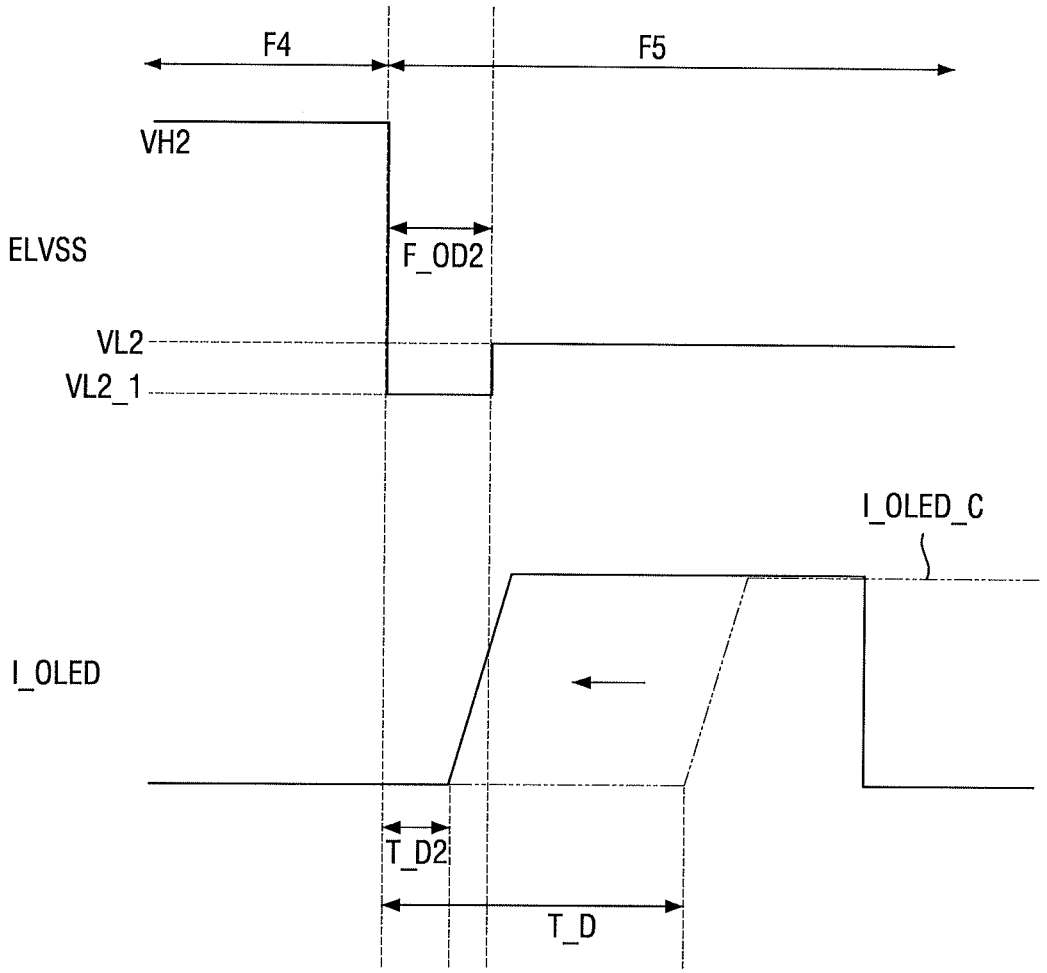
FIG. 6 illustrates a waveform diagram for an example of the operation of the pixel as the second supply voltage applied to the pixel of FIG. 2 changes.
Figure 7:
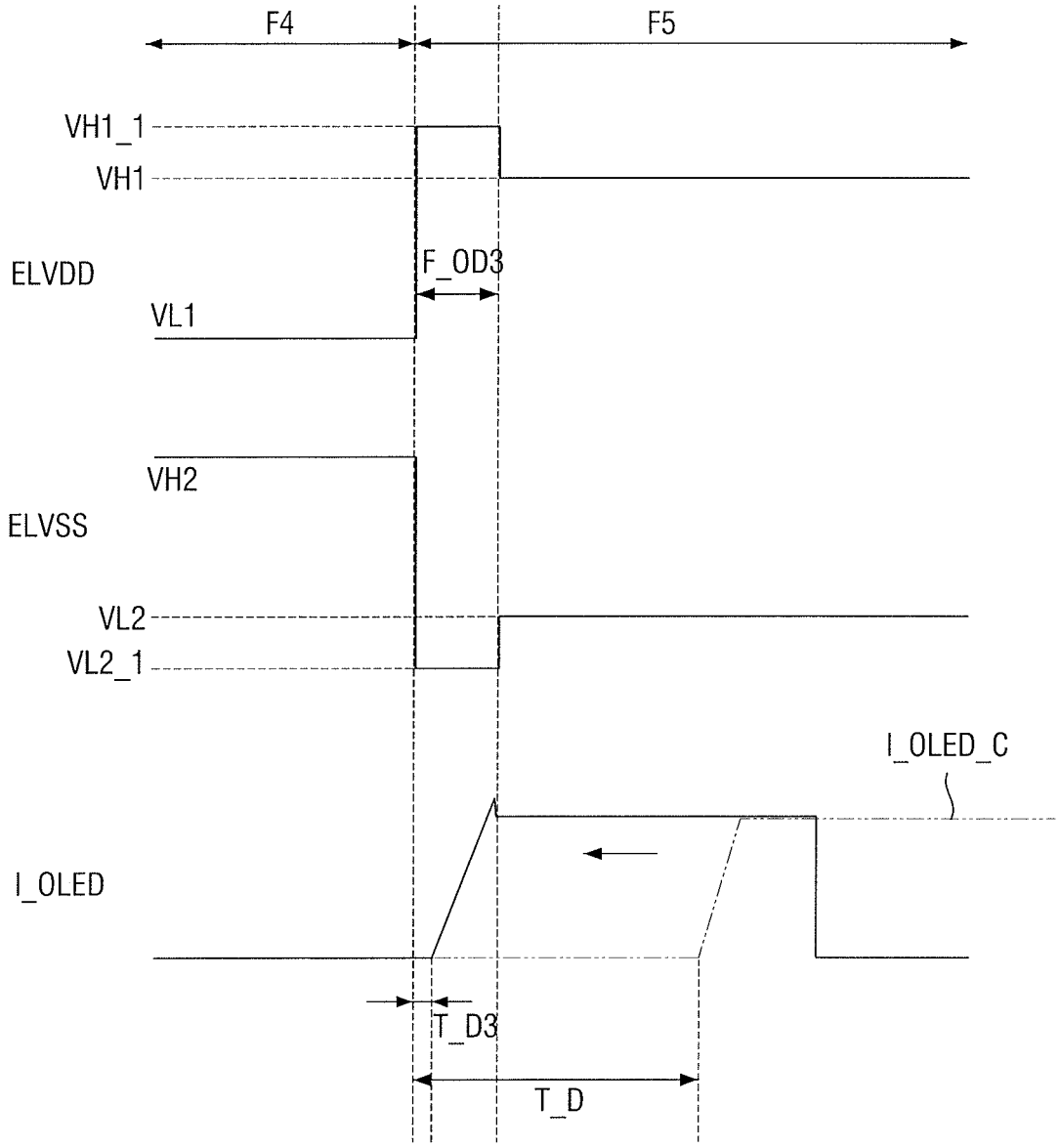
FIG. 7 illustrates a waveform diagram for another example of the operation of the pixel as the first and second supply voltages applied to the pixel of FIG. 2 change.

FIG. 4 is a waveform diagram illustrating the operation of the pixel according to normal mode as the first supply voltage applied to the pixel of FIG. 2 changes. FIG. 5 is a waveform diagram illustrating an example of the operation of the pixel as the first supply voltage applied to the pixel of FIG. 2 changes. FIG. 6 is a waveform diagram for illustrating an example of the operation of the pixel as the second supply voltage applied to the pixel of FIG. 2 changes. FIG. 7 is a waveform diagram illustrating another example of the operation of the pixel as the first and second supply voltages applied to the pixel of FIG. 2 change. In other words, FIGS. 5 to 7 illustrate examples of operation in a driving mode different from the normal mode.

Referring to FIGS. 2 to 4, as the first supply voltage ELVDD transitions (or increases) from the first low voltage level VL1 to the first high voltage level VH1 during the fifth period F5, e.g., at a start time of the fifth period F5, the voltage between the gate electrode and the first electrode of the first switching element T1 increases, so that the driving current I_OLED_C can flow through the light-emitting element OLED.

However, the driving current I_OLED_C may be transmitted with a delay in the light-emitting element OLED due to the resistance components between the second electrode of the first switching element T1 and the first element electrode of the light-emitting element OLED, the parasitic capacitor Coled, etc. For example, when the first supply voltage ELVDD transitions to the first high voltage level VH1, the current flowing through the first switching element T1 is charged first in the parasitic capacitor, so that the driving current I_OLED_C may be transmitted with a delay time T_D, and the driving current I_OLED_C may rise with a certain slope depending on the charging speed of the parasitic capacitor or the like.

When a data voltage corresponding to a high gray level is applied to the pixel PX (or the first switching element T1), the driving current I_OLED_C is relatively large and the emission delay T_D is relatively small. On the other hand, when a data voltage corresponding to a low gray level is applied to the pixel PX, the driving current I_OLED_C may be relatively small and the emission delay T_D may be relatively large. For example, when a data signal has a data voltage corresponding to 87 or less among the 255 gray levels, the delay time T_D occupies half the entire emission period F_E, such that the pixel PX may fail to emit light at a luminance corresponding to the data signal (i.e., desired luminance) generally.

Referring to FIG. 5, the first supply voltage ELVDD may transition (or increase) from the first low voltage level VL1 to the first overvoltage level VH1_1 at the start time of the emission period F5, may remain at the first overvoltage level VH1_1 during a first holding period F_OD1, and may transition (or decrease) to the first high voltage level VH1 after the first holding period F_OD1 has elapsed and remain there. The first overvoltage level VH1_1 may be greater than the first high voltage level VH1. That is to say, the first supply voltage ELVDD may be overdriven at the start time of the emission period F5. The voltage difference between the first supply voltage ELVDD and the second supply voltage ELVSS at the start time of the emission period F5 may be larger than the average voltage difference between the first supply voltage ELVDD and the second supply voltage ELVSS during the emission period F5. The power supply 40 described above with reference to FIG. 1 may generate the overdriven first supply voltage ELVDD at the start of the emission period F5 and provide it to the display panel 10.

As the first supply voltage ELVDD has the first overvoltage level VH1_1, the voltage (or voltage difference) between the gate electrode and the first electrode of the first switching element T1 increases. Thus, the driving current flowing through the first switching element T1 may temporarily increase. Accordingly, electric charges are stored more quickly in the parasitic capacitor of the light-emitting element OLED, and the first emission delay time T_D1 is reduced compared to the delay time T_D described above with reference to FIG. 4. As a result, deterioration of the display quality due to the emission delay may be reduced or prevented.

The first overvoltage level VH1_1 of the first supply voltage ELVDD may be larger than the first high voltage level VH1 by approximately 8% to 20%. For example, if the first high voltage level VH1 is approximately 6.2 V, the first overvoltage level VH1_1 may be approximately 6.7 V, or approximately 7.2 V. The emission delay time T_D1 may be reduced as the first overvoltage level VH1_1 is increased. However, as the first overvoltage level VH1_1 increases, a change in luminance may be perceived in another pixel (e.g., a pixel that emits light according to a data signal of a high gray level) or another pixel may be damaged due to the overcurrent. Therefore, when the first overvoltage level VH1_1 is larger than the first high voltage level VH1 by approximately 8% to 20%, the emission delay of the pixel PX that emits light in the low grayscale region can be reduced while preventing a change in the luminance of another pixel that emits light in the high grayscale region from being perceived.

The first holding time F_OD1 (i.e., the time when the first supply voltage ELVDD has the first overvoltage level VH1_1) may be one horizontal time (1H). The one horizontal time 1H may be equal to the period of time in which a scan signal GW[i] is applied to the pixel PX (or the second switching element T2), for example, approximately 3.8 μs, or approximately 2.4 μs. The first holding time F_OD1 decreases as the first overvoltage level VH1_1 increases. However, the first holding time F_OD1 may be one horizontal time by taking into account the voltage level of the first overvoltage level VH_1, the driving frequency of the power supply 40 described above, etc.

Referring to FIG. 6, similarly to the first supply voltage ELVDD, the first supply voltage ELVSS may transition (decrease) from the second high voltage level VH2 to the second overvoltage level VL2_1 at the start of the emission period F5, may remain at the second overvoltage level VL2_1 during the second holding period F_OD2 and may transition (increase) to the second low voltage level VL2 after the second holding period F_OD2 has elapsed to remain at it. The second overvoltage level VL2_1 may be lower, e.g., having a greater magnitude or absolute value, than the second low voltage level VL2. That is to say, the second supply voltage ELVSS may be overdriven at the start of the emission period F5. The power supply 40 described above with reference to FIG. 1 may generate the overdriven second supply voltage ELVSS at the start of the emission period F5 and may provide it to the display panel 10.

As the second supply voltage ELVSS has the second overvoltage level VL2_1, the voltage (or voltage difference) between the gate electrode and the second electrode of the first switching element T1 increases. Thus, the driving current flowing through the first switching element T1 may temporarily increase. Accordingly, the second emission delay time T_D2 can be reduced compared to the delay time T_D described above with reference to FIG. 4, so that it is possible to mitigate the deterioration of the display quality due to the emission delay.

Similarly to the first overvoltage level VH1_1 of the first supply voltage ELVDD, the second overvoltage level VL2_1 of the second supply voltage ELVSS may be less (greater magnitude or absolute value) than the second low voltage level VL2 by approximately 30% to 40%, compared to the first reference voltage of the first supply voltage ELVDD and the second supply voltage ELVSS (or a first reference voltage difference). For example, if the second low voltage level VL2 is approximately −2.2 V, the second overvoltage level VL2_1 may be approximately −5 V.

The second holding time F_OD2 (i.e., the time when the second supply voltage ELVDD has the second overvoltage level VL2_1) may be one horizontal time (1H), similarly to the first holding time F_OD1. In this case, the second emission delay time T_D2 may be substantially equal to the first emission delay time T_D1.

Referring to FIGS. 5 to 7, at the start of the emitting period F5, each of the first supply voltage ELVDD and the second supply voltage ELVSS may be overdriven. The overdrive of the first supply voltage ELVDD may be substantially identical to the overdrive of the first supply voltage ELVDD described above with reference to FIG. 5, and the overdrive of the second supply voltage ELVSS may be substantially identical to the overdrive of the second supply voltage ELVSS described above with reference to FIG. 6. Therefore, descriptions of the identical elements will not be repeated.

A third holding time F_OD3 may be substantially equal to the first holding time F_OD1 described above with reference to FIG. 5 or the second holding time F_OD2 described above with reference to FIG. 6. It is to be noted that the third emission delay time T_D3 may be shorter than the first emission delay time T_D1 (or the second emission delay time T_D2) due to the overdrive of each of the first supply voltage ELVDD and the second supply voltage ELVSS.

On the other hand, the driving current I_OLED flowing through the light-emitting element OLED may be partially overshot. However, an increase or a change in the luminance due to the overshooting is insignificant relative to the total emission amount of the light-emitting element OLED and, thus, may not be perceived by a user.

As described with reference to FIGS. 4 to 7, the first supply voltage ELVDD and/or the second supply voltage ELVSS is overdriven at the start of the emission period F5, so that the transmission delay of the driving current I_OLED flowing in the light-emitting element OLED or the emission delay of the light-emitting element OLED can be reduced. In particular, in FIGS. 5 to 7, the voltage difference between the first supply voltage ELVDD and the second supply voltage ELVSS at the start time of the emission period F5 may be larger than the average voltage difference between the first supply voltage ELVDD and the second supply voltage ELVSS during the emission period F5. Therefore, mura (the phenomenon that a low grayscale image fails to be represented properly so that it looks like a stain) due to the emission delay of the light-emitting element OLED (especially the light-emitting element OLED that emits light based on a low-grayscale data signal) may be reduced or prevented.

Figure 8:
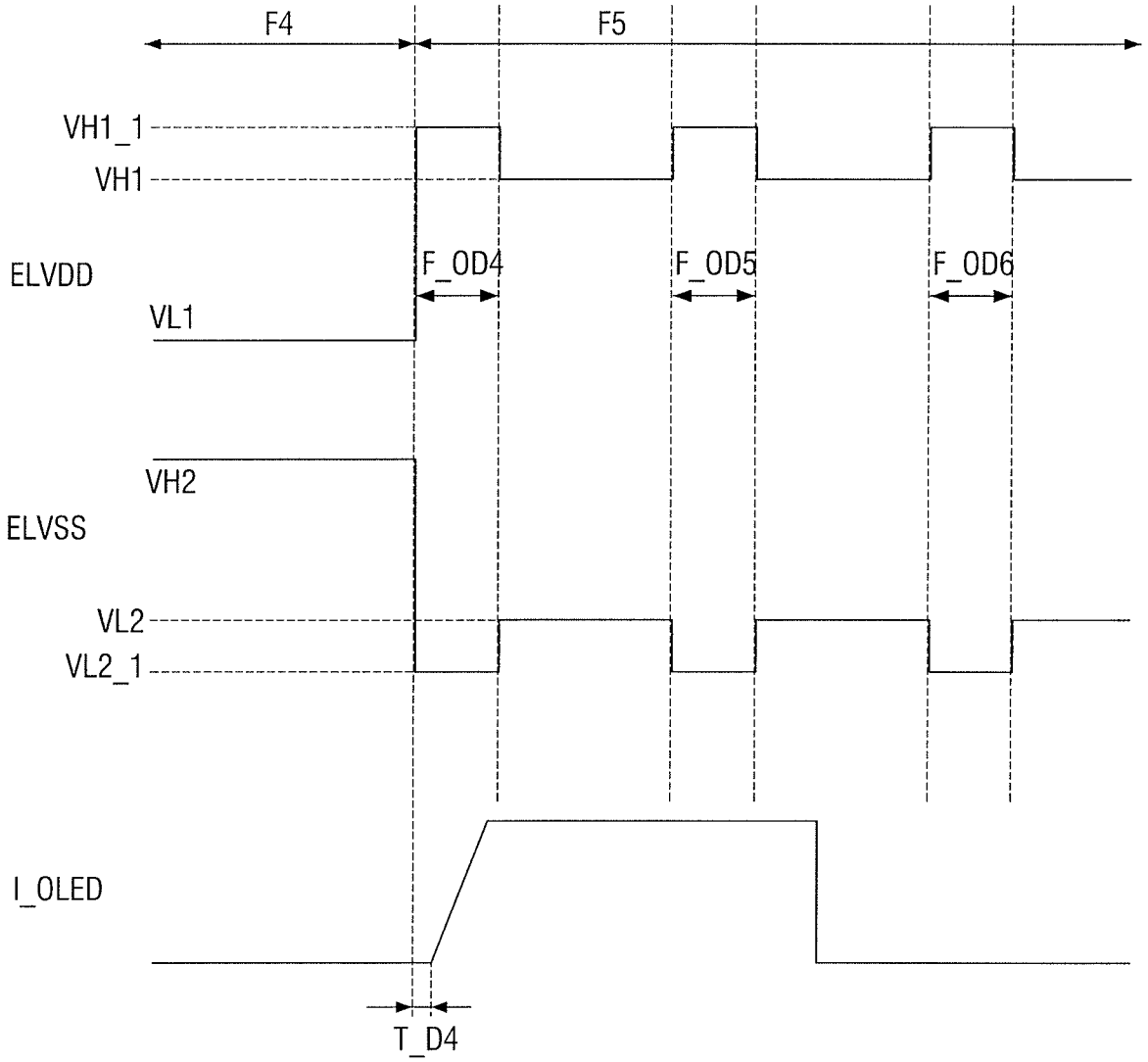
FIG. 8 illustrates a waveform diagram for another example of the operation of the pixel as the first and second supply voltages applied to the pixel of FIG. 2 change.

FIG. 8 is a waveform diagram for illustrating another example of the operation of the pixel as the first and second supply voltages applied to the pixel of FIG. 2 change. Referring to FIGS. 1 to 3, 7 and 8, the first supply voltage ELVDD and the second supply voltage ELVSS according to this exemplary embodiment are different from the first supply voltage ELVDD and the second supply voltage ELVSS described above with reference to FIG. 7 in that they are overdriven a number of times during the emission period F5.

The first supply voltage ELVDD and the second supply voltage ELVSS may be first overdriven at the start of the emission period F5. The fourth holding period F_OD4 in which the first supply voltage ELVDD and the second supply voltage ELVSS are overdriven may be substantially equal to the third holding period F_OD3 described above with reference to FIG. 7. Accordingly, the fourth emission delay time T_D4 of the light-emitting element OLED relatively decreases and may be substantially equal to the third emission delay time T_D3 described above with reference to FIG. 7.

Subsequently, the first supply voltage ELVDD and the second supply voltage ELVSS may be second overdriven during the fifth holding period F_OD5, after a predetermined period of time has been elapsed from the first overdrive during the emission period F5. The fifth holding time F_OD5 may be equal to the fourth holding time F_OD4.

By doing so, the driving current I_OLED flowing through the light-emitting element OLED temporarily increases, and the light-emitting element OLED can emit light with a relatively high luminance temporarily.

Although the fourth emission delay time T_D4 is not reduced by the second overdrive, the second overdrive temporarily increases the luminance of the light-emitting element OLED so that the insufficient luminance during the fourth emission delay time T_D4 can be compensated for. Specifically, since the luminance is determined based on the total amount of light emitted from the light-emitting element OLED during the emission period F5, the luminance of the pixel PX (e.g., the pixel that emits light in response to a low-grayscale data signal with a relatively large emission delay) can be compensated for by the second overdrive. As a result, the display quality can be improved.

After a predetermined period of time has elapsed since the second overdrive during the emission period F5, the first supply voltage ELVDD and the second supply voltage ELVSS may be third overdriven during the sixth holding period F_OD6. The sixth holding time F_OD6 may be equal to the fifth holding time F_OD5. Similar to the second overdrive, the insufficient luminance of the pixel PX can be compensated for by the third overdrive.

As described above with reference to FIG. 8, the first supply voltage ELVDD and the second supply voltage ELVSS are overdriven a number of time during the emission period F5, so that the emission delay time T_D4 can be reduced, and insufficient luminance of the pixel PX due to the emission delay time T_D4 can be compensated. Thus, the voltage difference between the first supply voltage ELVDD and the second supply voltage ELVSS during overdriving, including a start of the emission period F5, may be larger than the average voltage difference between the first supply voltage ELVDD and the second supply voltage ELVSS during the emission period F5. As a result, it is possible to prevent or further mitigate the deterioration of the display quality.

In FIG. 8, the first supply voltage ELVDD and the second supply voltage ELVSS are shown to be overdriven three times, but the present disclosure is not limited thereto. For example, the first supply voltage ELVDD and the second supply voltage ELVSS may be overdriven two, four or more times. In addition, at least one of the first supply voltage ELVDD and the second supply voltage ELVSS may be overdriven a number of times.

Figure 9:
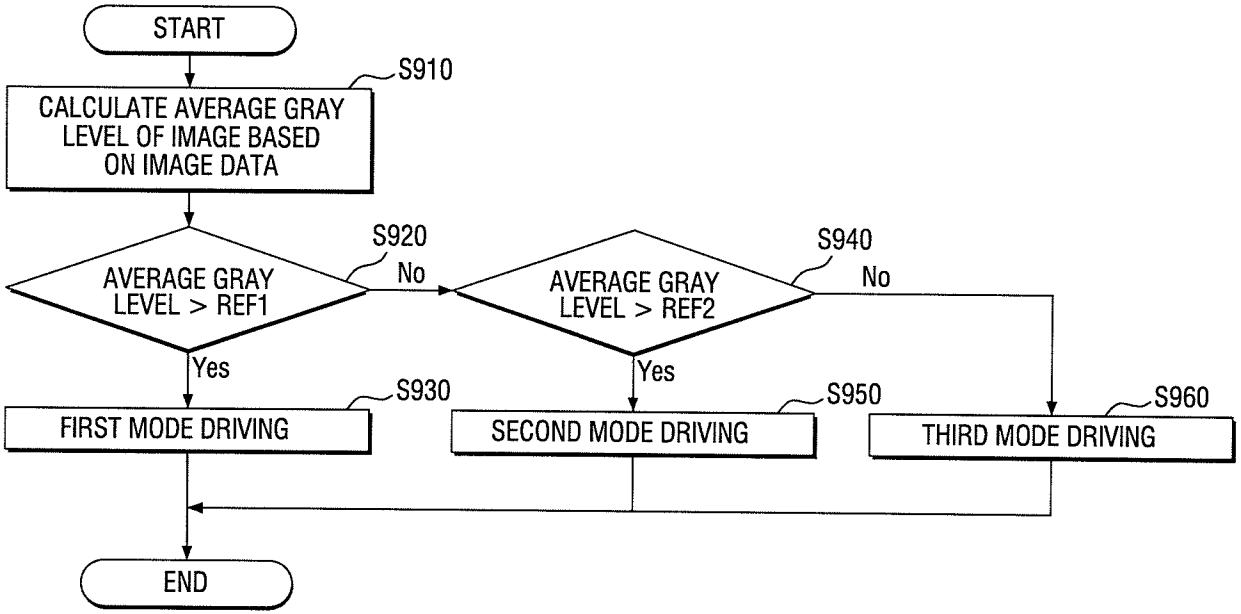
FIG. 9 illustrates a flowchart of a method for driving the display device of FIG. 1.

FIG. 9 is a flowchart for illustrating a method for driving the display device of FIG. 1. Referring to FIGS. 1 to 3 and FIGS. 7 to 9, the method of FIG. 9 may be performed in the display device 1. As described in detail below, a voltage difference between the first supply voltage and the second supply voltage, e.g., a start of the emission period or during the emission period, may vary according to the average gray level of the image data. In particular, when an average gray level is above a first reference gray level, a first or normal mode in which no overdriving is employed during the emission period; when an average gray level is between the first reference gray level and a second reference gray level, lower than the first reference gray level, a second mode in which overdriving is used at a start of the emission period is employed; and, when an average gray level is below the second reference gray level, a third mode in which overdriving is used throughout the emission period is employed.

The method illustrated in FIG. 9 may include calculating the average gray level (or average luminance) of an image based on image data (operation S910). For example, the timing controller 50 may calculate the average gray level by averaging gray levels (or grayscale values) included in image data (or frame data included in the image data) provided from an extended device. As another example, the timing controller 50 may calculate the average gray level and may calculate the average luminance of the image data (or frame data) based on the maximum luminance of the display device 1. The maximum luminance may vary depending on the operation environment of the display device 1 (for example, when the display device 1 is driven under sunlight or indoors). Even if the average gray level is high, the display device may emit light with a low luminance. This is because a mura may occur even in the high grayscale region (for example, even when the average gray level is relatively high).

Thereafter, the method of FIG. 9 may determine whether the average gray level is greater or higher than a first reference gray level REF1 (operation S920). For example, the first reference gray level REF1 may be a 128 gray level of the maximum of 255 grays levels. In the example, the method of FIG. 9 may include determining whether the average gray level is larger than 128 gray level. Alternatively, calculating the average luminance by the method of FIG. 9 may include determining whether the average luminance is higher than the first reference brightness. For example, the first reference brightness may be 16 nit.

If the average gray level is larger than the first reference gray level REF1, the display device 1 displays the image in the relatively high grayscale region, so that the display quality in the low grayscale region does not deteriorate or no mura may be perceived.

Accordingly, when the average gray level is larger than the first reference gray level REF1, the method of FIG. 9 may include driving the display device 1 (or the display panel 10) in a first mode (or a first driving mode) (operation S930). As shown in FIG. 4, the first mode may be a normal driving mode in which the first supply voltage ELVDD and the second supply voltage ELVSS are not overdriven. For example, the timing controller 50 may generate a third control signal CTL3 associated with the first mode, and the power supply 40 may generate the first supply voltage ELVDD having only the first high voltage level VH1 and the second supply voltage ELVSS having only the second low voltage level VL2 during the emission period F5 of the frame in response to the third control signal CTL3 and may provide to them to the display panel 10.

When the average gray level is smaller than the first reference gray level REF1, the method of FIG. 9 may include determining whether the average gray level is larger than the second reference gray level REF2 (operation S940).

For example, when the first reference gray level REF1 is 128 of the maximum 255 gray levels, the second reference gray level may be, but is not limited to, 87 gray level. In the example, the method of FIG. 9 may include determining whether the average gray level is larger than 87 gray level.

On the other hand, when calculating the average luminance by the method of FIG. 9, the method may include determining whether the average luminance is higher than the second reference brightness. For example, the second reference brightness may be 10 nit.

The method of FIG. 9 may include predicting there are some emission delays of the pixels PX throughout the display panel 10 when the average gray level is greater than the second reference gray level REF2 (and the average gray level is smaller than the first reference gray level REF1). Accordingly, the method of FIG. 9 may include driving the display device 1 (or the display panel 10) in a second mode (or a second driving mode) (operation S950). As shown in FIGS. 5 to 7, the second mode may be a normal driving mode in which the first supply voltage ELVDD and/or the second supply voltage ELVSS are overdriven once. For example, the timing controller 50 may generate a third control signal CTL3 associated with the second mode, and the power supply 40 may generate the overdriven first supply voltage ELVDD (or having the first overvoltage level VH1_1) and the overdriven second supply voltage ELVSS (or having the second overvoltage level VL2_1 at the start of the emission period F5 of the frame in response to the third control signal CTL3 and may provide to them to the display panel 10.

When the average gray level is less than the second reference gray level REF2, the method of FIG. 9 may include driving the display device 1 (or the display panel 10) in a third mode (operation S960). The third mode may be a driving mode in which the first supply voltage ELVDD and/or the second supply voltage ELVSS are overdriven a number of times. That is to say, when the average gray level is smaller than the second reference gray level REF2, the method of FIG. 9 may include predicting there are emission delay and the luminance decrease of the pixels PX throughout the display panel 10. Accordingly, the timing controller 50 may generate a third control signal CTL3 associated with the second mode, and the power supply 40 may generate the overdriven first supply voltage ELVDD (or having the first overvoltage level VH1_1) and the overdriven second supply voltage ELVSS (or having the second overvoltage level VL2_1 at the start of the emission period F5 of the frame and the intermediate in the emission period F5 in response to the third control signal CTL3 and may provide to them to the display panel 10.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

By way of summation and review, a pixel includes a driving transistor for driving an organic light-emitting element. A driving current is supplied to the organic light-emitting element through the driving transistor. The smaller the driving current is, the more likely the emission of the organic light-emitting element is delayed, such that the display quality may deteriorate, i.e., a mura may occur, which is a stain caused by such emission delay.

Aspects of the present disclosure provide a display device capable of improving display quality in a high-resolution structure. According to exemplary embodiments of the present disclosure, there is provided a display device with improved display quality while achieving a high resolution. As a result, the luminance of a displayed image of the low grayscale region can be compensated for, and the display quality can be further improved.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device, comprising:

a display panel including pixels;

a panel driver to supply a scan signal and a data signal to the pixels; and a power supply to generate and supply a first supply voltage and a second supply voltage to the pixels, wherein the pixels emit light in response to the scan signal based on the data signal during an emission period where a voltage difference between the first supply voltage and the second supply voltage is larger than a first reference voltage, a first voltage difference between the first supply voltage and the second supply voltage at a start of the emission period is larger than an average voltage difference between the first supply voltage and the second supply voltage throughout the emission period, the first supply voltage transitions from a first low voltage level to a first overvoltage level at the start of the emission period, and transitions to a first high voltage level after a first holding time has elapsed from the start of the emission period, the first high voltage level is higher than the first low voltage level and lower than the first overvoltage level, the second supply voltage transitions from a second high voltage level to a second overvoltage level at the start of the emission period, and transitions to a second low voltage level after a second holding time has elapsed from the start of the emission period, and the second low voltage level is lower than the second high voltage level and higher than the second overvoltage level.

2. The display device as claimed in claim 1, wherein the first overvoltage level is greater than the first high voltage level by approximately 10% to 20%.

3. The display device as claimed in claim 1, wherein the first holding time is equal to a period of time in which the scan signal is applied to the pixels.

4. The display device as claimed in claim 1, wherein the second overvoltage level is lower than the second low voltage level by approximately 30% to 40% of the voltage difference between the first high voltage level and the second low voltage level.

5. The display device as claimed in claim 1, wherein the second holding time is equal to a period of time in which the scan signal is applied to the pixels.

6. The display device as claimed in claim 1, wherein:

the second supply voltage transitions from a second high voltage level to a second overvoltage level at the start of the emission period, and transitions to a second low voltage level after a second holding time has elapsed from the start of the emission period, and the second low voltage level is lower than the second high voltage level and higher than the second overvoltage level.

7. The display device as claimed in claim 1, further comprising:

a data line for transmitting the data signal; and an initialization power line for transmitting an initializing voltage, wherein each of the pixels includes:

a light-emitting element, a first switching element having a first electrode receiving the first supply voltage, a second electrode connected to the first electrode of the light-emitting element, and a gate electrode connected to a first node, a second switching element including a first electrode connected to the first node, a second electrode connected to a second node, and a gate electrode receiving the scan signal, a third switching element including a first electrode connected to the second node, a second electrode connected to the first electrode of the light-emitting element, and a gate electrode for receiving a common control signal, a first capacitor connected between first node and the initialization power line, and a second capacitor connected between the data line and a third node.

8. The display device as claimed in claim 7, wherein each of the first switching element, the second switching element and the third switching element is a PMOS (p-channel metal-oxide-semiconductor) transistor.

9. The display device as claimed in claim 1, wherein the voltage difference between the first supply voltage and the second supply voltage increases more than the average voltage difference during the emission period twice or more.

10. The display device as claimed in claim 9, wherein:

the first supply voltage transitions from a first low voltage level to a first overvoltage level at the start of the emission period, transitions to a first high voltage level after a first holding time has elapsed from the start of the emission period, transitions to the first overvoltage level at a first time during the emission period that is different from the start, and transitions to the first high voltage level at a second time after a second holding time has elapsed from the first time, and the first high voltage level is higher than the first low voltage level and lower than the first overvoltage level.

11. The display device as claimed in claim 10, wherein the second holding time is equal to the first holding time.

12. The display device as claimed in claim 9, wherein:

the second supply voltage transitions from a second high voltage level to a second overvoltage level at the start of the emission period, transitions to a second low voltage level after a second holding time has elapsed from the start of the emission period, transitions to the second overvoltage level at a second time the emission period that is different from the start, and transitions to the second low voltage level at a third time after a second holding time has elapsed from the second time, and the second low voltage level is lower than the second high voltage level and higher than the second overvoltage level.

13. The display device as claimed in claim 1, further comprising:

a timing controller to receive image data comprising a grayscale value associated with each of the pixels, to calculate an average gray level of the image data, and to generate a control signal based on the average gray level, wherein the power supply generates the first supply voltage and the second supply voltage based on the control signal.

14. The display device as claimed in claim 13, wherein:

the timing controller generates a first control signal when the average gray level is smaller than a first reference gray level, and the power supply generates the first supply voltage and the second supply voltage having the first voltage difference therebetween based on the first control signal.

15. The display device as claimed in claim 14, wherein:

the timing controller generates a second control signal when the average gray level is larger than the first reference gray level, and the power supply generates the first supply voltage and the second supply voltage having the first voltage difference therebetween based on the second control signal.

16. The display device as claimed in claim 14, wherein:

the timing controller generates a third control signal when the average gray level is smaller than a second reference gray level, and the power supply generates the first supply voltage and the second supply voltage having a second voltage difference therebetween based on the third control signal at a first time of the emission period that is different from the start, and the second voltage difference is larger than the average voltage difference.

17. A display device, comprising:

a display panel including pixels;

a panel driver to supply a scan signal and a data signal to the pixels;

a timing controller to receive image data including a gray value associated with each of the pixels and to generate a control signal based on the image data; and a power supply to generate a first supply voltage and a second supply voltage to provide them to the pixels and to change the first supply voltage and/or the second supply voltage based on the control signal, wherein the pixels emit light in response to the scan signal based on the data signal during an emission period where a voltage difference between the first supply voltage and the second supply voltage is larger than a first reference voltage, during the emission period, the voltage difference between the first supply voltage and the second supply voltage varies according to an average gray level of the image data, and a first voltage difference between the first supply voltage and the second supply voltage at a start of the emission period is larger than an average voltage difference between the first supply voltage and the second supply voltage during the entire emission period, the first supply voltage transitions from a first low voltage level to a first overvoltage level at the start of the emission period, and transitions to a first high voltage level after a first bolding time has elapsed from the start of the emission period, the first high voltage level is higher than the first low voltage level and lower than the first overvoltage level, the second supply voltage transitions from a second high voltage level to a second overvoltage level at the start of the emission period, and transitions to a second low voltage level after a second bolding time has elapsed from the start of the emission period, and the second low voltage level is lower than the second high voltage level and higher than the second overvoltage level.

* * * * *